US005839450A

United States Patent [19]

Glasscock

[11] Patent Number: 5,839,450

[45] Date of Patent: Nov. 24, 1998

[54] HAIR CURLER

[76] Inventor: Edwina Glasscock, 3503 5th Ave. West, Palmetto, Fla. 34221

[21] Appl. No.: 95,974

[22] Filed: Jun. 11, 1998

[51] Int. Cl.[6] ..... A45D 2/12

[52] U.S. Cl. ..... 132/252; 132/250; 132/260

[58] Field of Search ..... 132/254, 250, 132/252, 251, 253, 260, 261, 226, 237, 245

[56] References Cited

U.S. PATENT DOCUMENTS

| | | | |
|---|---|---|---|
| 3,108,604 | 10/1963 | Krull | 132/250 |
| 3,358,698 | 12/1967 | Blanchard | 132/252 |
| 3,500,836 | 3/1970 | Jordan | 132/252 |
| 3,523,542 | 8/1970 | Eisler | 132/252 |
| 4,627,452 | 12/1986 | Caruso | 132/252 |
| 5,299,367 | 4/1994 | Johnson et al. | 132/252 |
| 5,711,324 | 1/1998 | Johnson et al. | 132/252 |

FOREIGN PATENT DOCUMENTS

| | | | |
|---|---|---|---|
| 2004952 | 12/1969 | France | 132/251 |
| 3406065 | 8/1985 | Germany | 132/251 |
| 1206938 | 9/1970 | United Kingdom | 132/252 |
| 2160418 | 12/1985 | United Kingdom | 132/252 |

*Primary Examiner*—Paul J. Hirsch

[57] ABSTRACT

A new hair curler for simulating the user's hair when the curler is in use curling the user's real hair. The inventive device includes an elongate tubular member and an elongate casing member detachably attachable to the outer surface of the tubular member. A plurality of elongate flexible strands adapted to resemble human hair are coupled to the casing member.

15 Claims, 2 Drawing Sheets

HAIR CURLER

BACKGROUND OF THE INVENTION

1. Field of the Invention

The present invention relates to hair curlers and more particularly pertains to a new hair curler for simulating the user's hair when the curler is in use curling the user's real hair.

2. Description of the Prior Art

The use of hair curlers is known in the prior art. More specifically, hair curlers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair curlers include U.S. Pat. No. 4,002,180; U.S. Pat. No. 2,391,284; U.S. Pat. No. Des. 302,138; U.S. Pat. No. 4,205,693; U.S. Pat. No. 3,105,503; and U.S. Pat. No. 4,823,458.

While these devices fulfill their respective, particular objectives and requirements, the aforementioned patents do not disclose a new hair curler. The inventive device includes an elongate tubular member and an elongate casing member detachably attachable to the outer surface of the tubular member. A plurality of elongate flexible strands adapted to resemble human hair are coupled to the casing member.

In these respects, the hair curler according to the present invention substantially departs from the conventional concepts and designs of the prior art, and in so doing provides an apparatus primarily developed for the purpose of simulating the user's hair when the curler is in use curling the user's real hair.

SUMMARY OF THE INVENTION

In view of the foregoing disadvantages inherent in the known types of hair curlers now present in the prior art, the present invention provides a new hair curler construction wherein the same can be utilized for simulating the user's hair when the curler is in use curling the user's real hair.

The general purpose of the present invention, which will be described subsequently in greater detail, is to provide a new hair curler apparatus and method which has many of the advantages of the hair curlers mentioned heretofore and many novel features that result in a new hair curler which is not anticipated, rendered obvious, suggested, or even implied by any of the prior art hair curlers, either alone or in any combination thereof.

To attain this, the present invention generally comprises an elongate tubular member and an elongate casing member detachably attachable to the outer surface of the tubular member. A plurality of elongate flexible strands adapted to resemble human hair are coupled to the casing member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair curler apparatus and method which has many of the advantages of the hair curlers mentioned heretofore and many novel features that result in a new hair curler which is not anticipated, rendered obvious, suggested, or even implied by any of the prior art hair curlers, either alone or in any combination thereof.

It is another object of the present invention to provide a new hair curler which may be easily and efficiently manufactured and marketed.

It is a further object of the present invention to provide a new hair curler which is of a durable and reliable construction.

An even further object of the present invention is to provide a new hair curler which is susceptible of a low cost of manufacture with regard to both materials and labor, and which accordingly is then susceptible of low prices of sale to the consuming public, thereby making such hair curler economically available to the buying public.

Still yet another object of the present invention is to provide a new hair curler which provides in the apparatuses and methods of the prior art some of the advantages thereof, while simultaneously overcoming some of the disadvantages normally associated therewith.

Still another object of the present invention is to provide a new hair curler for simulating the user's hair when the curler is in use curling the user's real hair.

Yet another object of the present invention is to provide a new hair curler which includes an elongate tubular member and an elongate casing member detachably attachable to the outer surface of the tubular member. A plurality of elongate flexible strands adapted to resemble human hair are coupled to the casing member.

Still yet another object of the present invention is to provide a new hair curler that disguise the fact that a user is wearing curlers.

Even still another object of the present invention is to provide a new hair curler that is comfortable enough to wear when a user is sleeping.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
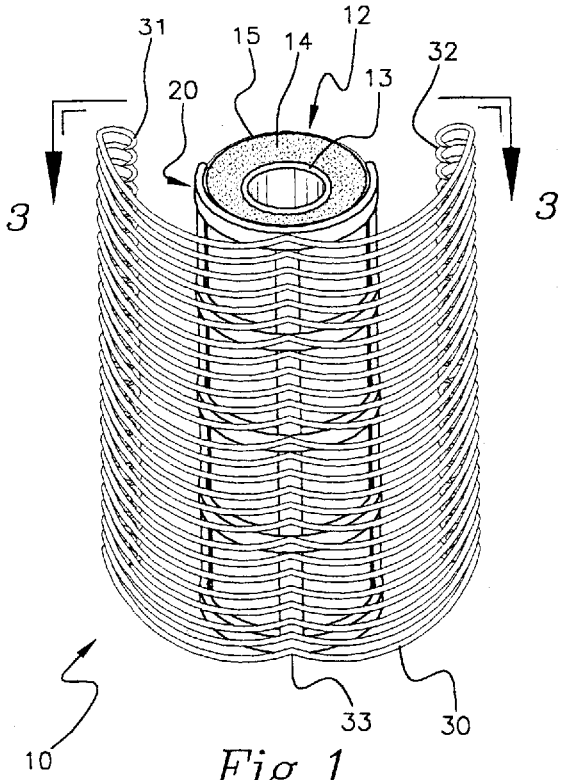
FIG. 1 is a schematic perspective view of a new hair curler according to the present invention.
Figure 2:
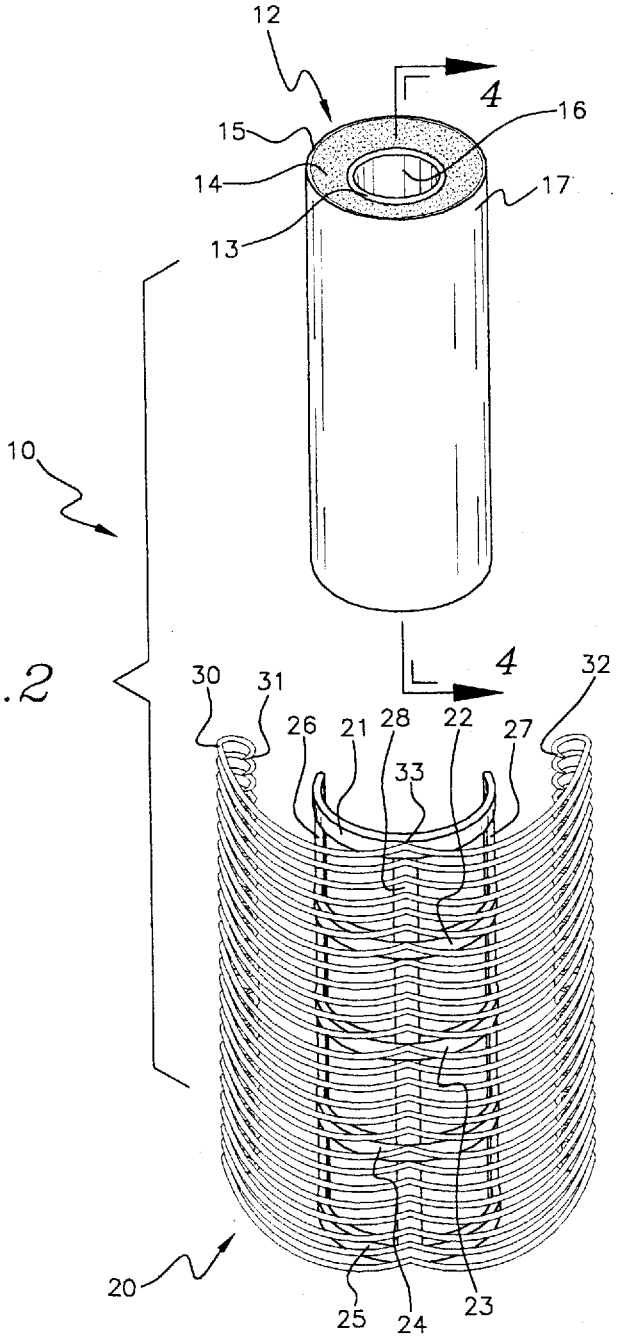
FIG. 2 is a schematic exploded perspective view of the present invention.
Figure 3:
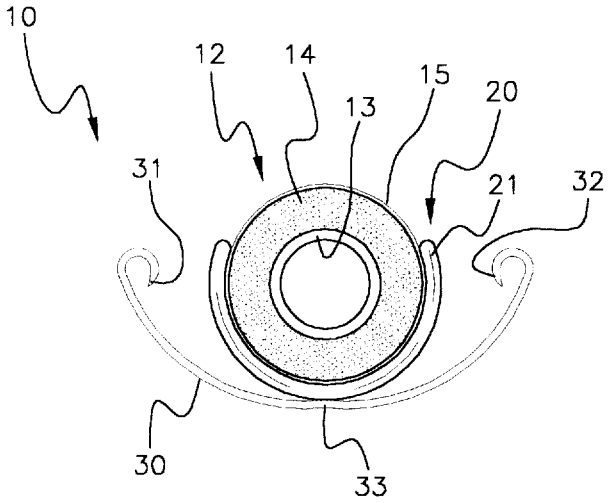
FIG. 3 is a schematic end side view of the present invention as seen from the vantage of line 3—3 of FIG. 1.
Figure 4:
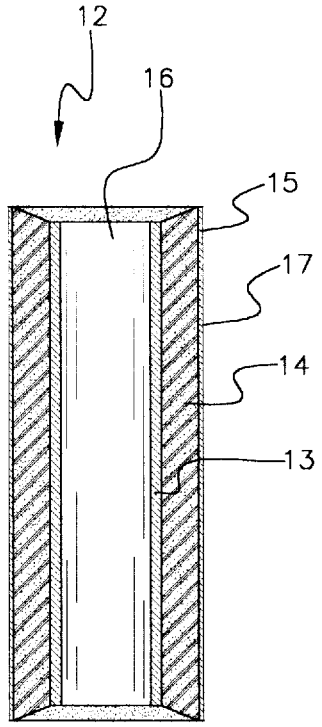
FIG. 4 is a schematic cross sectional view of the tubular member of the present invention taken from line 4—4 on FIG. 2.

With reference now to the drawings, and in particular to FIGS. 1 through 4 thereof, a new hair curler embodying the principles and concepts of the present invention and generally designated by the reference numeral 10 will be described.

As best illustrated in FIGS. 1 through 4, the hair curler 10 generally comprises an elongate tubular member 12 and an elongate casing member 20 detachably attachable to the outer surface 17 of the tubular member 12. A plurality of elongate flexible strands 30 adapted to resemble human hair are coupled to the casing member 20.

In closer detail, the elongate tubular member 12 is generally cylindrical and has inner and outer surfaces 16,17, and a pair of opposite open ends. Preferably, the tubular member 12 has inner, middle, and outer layers 13,14,15. The inner layer 13 is located adjacent the inner surface 16 of the tubular member 12 and defines the inner surface 16. The outer layer 15 is located adjacent outer surface 17 of the tubular member 12 and defines the outer surface 17. The middle layer 14 is interposed between the inner and outer layers 13,15.

Ideally, the inner layer 13 is generally transparent, such as a generally transparent hard plastic. In this ideal embodiment, the middle layer 14 comprises a resiliently compressible material, preferably a foamed material. Even more ideally, the middle layer 14 is also generally transparent. The outer layer 15 is also ideally generally transparent, and comprises a generally transparent plastic film. In the ideal embodiment, the thickness of the outer layer 15 is less than the thickness of the inner layer 13, and the thickness of the inner layer 13 is less than the thickness of the middle layer 14. While the tubular member may be any size, in an ideal illustrative embodiment, the tubular member 12 has a diameter of less than about ¾ inch, and a length defined between the ends of the tubular member 12 of less than about 2 inches.

The elongate casing member 20 preferably has a generally C-shaped cross section and is detachably attachable to the outer surface 17 of the tubular member 12. The casing member 20 has a plurality of ribs 21,22,23,24,25 and a plurality of elongate strips 26,27,28. Even more preferably, the casing member has at least five ribs and at least three elongate strips. Ideally, the casing member 20 is transparent and comprises a resiliently deflectable material such as a resiliently deflectable plastic. Each of the ribs 21,22,23,24,25 is generally C-shaped and has a pair of terminal ends and an arcuate portion. The arcuate portion of the rib has a mid-point substantially equidistant between the terminal ends of the rib.

Each of the elongate strips 26,27,28 has a pair of opposite ends. The elongate strips 26,27,28 are coupled to each of the ribs 21,22,23,24,25. The ribs 21,22,23,24,25 are spaced apart from one another and preferably generally parallel with one another. Ideally, the ribs are spaced apart substantially equidistant to one another. One of the ribs 21 is preferably positioned adjacent one of the ends of each of the elongate strips 26,27,28 while a second rib 25 is positioned adjacent the opposite ends of the elongate strips. The rest of the ribs 22,23,24 are interposed between the two end ribs 21,25. Preferably, the elongate strips 26,27,28 are spaced apart from one another and are extended generally parallel to one another. In the preferred embodiment, one of the elongate strips 26 is positioned adjacent one of the terminal ends of each of the ribs 21,22,23,24,25 while another of the elongate strips 28 is positioned adjacent the other terminal end of each of the ribs 21,22,23,24,25. A third of the elongate strips 27 is positioned adjacent the midpoint of the arcuate portion of each of the ribs 21,22,23,24,25. Ideally, the lengths of the elongate strips 26,27,28 are generally perpendicular to the lengths of the ribs 21,22,23,24,25. In use, the ribs 21,22,23,24,25 are extendable around a portion of the outer surface 17 of the tubular member 12 such that the tubular member 12 is held that is attached to the casing member 20 to detachably attach the casing member 20 to the tubular member 12.

The plurality of elongate flexible strands 30 are adapted to resemble human hair and may be styled by a user as desired. Each of the flexible strands 30 has a pair of opposite ends 31,32 and a midpoint 33 between the ends 31,32 of the flexible strand 30. The midpoints of each of the flexible strands 30 is coupled to the third elongate strip 27 of the casing member 20 such that the ends 31,32 of the flexible strands 30 extend outwardly from the third elongate strips 27.

In use, the tubular member and the casing member are used as a traditional hair curler. When the tubular member and casing member are attached to a user's hair, the strands 30 extend over the tubular member and casing member to cover and camouflage them from view. The strands may be styled in a variety of ways to help camouflage the hair curler.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair curler, comprising:

an elongate tubular member having inner and outers surfaces, and a pair of opposite ends;

an elongate casing member being detachably attachable to said outer surface of said tubular member, said casing member having a plurality of ribs and a plurality of elongate strips;

each of said ribs having a pair of terminal ends and an arcuate portion, said arcuate portion of said rib having a midpoint substantially equidistant between said terminal ends of said rib;

each of said elongate strips having a pair of opposite ends, each of said elongate strips being coupled to each of said ribs;

wherein said ribs are extendable around a portion of said outer surface of said tubular member such that said tubular member is held to said casing member to detachably attach said casing member to said tubular member; and a plurality of elongate flexible strands being adapted to resemble human hair, each of said flexible strands having a pair of opposite ends and a midpoint between said ends of said flexible strand, each of said flexible strands being coupled to said casing member.

2. The hair curler of claim 1, wherein said tubular member being generally cylindrical, said casing member has a generally C-shaped cross section, and each of said ribs is generally C-shaped.

3. The hair curler of claim 1, wherein said tubular member has inner, middle, and outer layers, said inner layer being located adjacent said inner surface of said tubular member, said outer layer being located adjacent outer surface of said tubular member, said middle layer being interposed between said inner and outer layers.

4. The hair curler of claim 3, wherein said inner layer is generally transparent, wherein said middle layer comprises a resiliently compressible material, wherein said middle layer is generally transparent, and wherein said outer layer is generally transparent.

5. The hair curler of claim 4, wherein said middle layer comprises a foamed material, and wherein said outer layer comprises a generally transparent plastic film.

6. The hair curler of claim 3, wherein the thickness of said outer layer is less than the thickness of said inner layer, wherein the thickness of said inner layer is less than the thickness of said middle layer.

7. The hair curler of claim 2, wherein said tubular member has a diameter, said diameter being less than about ¾ inch, and wherein said tubular member has a length defined between said ends of said tubular member, wherein said length is less than about 2 inches.

8. The hair curler of claim 1, wherein said casing member is transparent and comprises a resiliently deflectable material.

9. The hair curler of claim 1, said ribs are spaced apart from one another and generally parallel with one another,

10. The hair curler of claim 9, wherein said ribs are spaced apart substantially equidistant to one another.

11. The hair curler of claim 1, wherein said plurality of ribs comprises five ribs, a first of said ribs being positioned adjacent one of said ends of each of said elongate strips, a second of said ribs being positioned adjacent another of said ends of each of said elongate strips, the rest of said plurality of ribs being interposed between said first and second of said ribs.

12. The hair curler of claim 1, wherein said elongate strips are spaced apart from one another and being extended generally parallel to one another.

13. The hair curler of claim 1, wherein said plurality of elongate strips comprises three elongate strips, a first of said elongate strips being positioned adjacent one of said terminal ends of each of said ribs, a second of said elongate strips being positioned adjacent another of said terminal ends of each of said ribs, a third of said elongate strips being positioned adjacent said mid-point of said arcuate portion of each of said ribs.

14. The hair curler of claim 13, wherein the midpoints of each of said flexible strands being are to said third of said elongate strips of said casing member such that said ends of said flexible strand extend outwardly from said third of said elongate strips.

15. A hair curler, comprising:

an elongate tubular member being generally cylindrical and having inner and outers surfaces, and a pair of opposite open ends;

said tubular member having inner, middle, and outer layers, said inner layer being located adjacent said inner surface of said tubular member, said outer layer being located adjacent outer surface of said tubular member, said middle layer being interposed between said inner and outer layers;

wherein said inner layer is generally transparent, wherein said inner layer comprises a generally transparent plastic;

wherein said middle layer comprises a resiliently compressible material, wherein said middle layer comprises a foamed material, wherein said middle layer is generally transparent;

wherein said outer layer is generally transparent, wherein said outer layer comprises a generally transparent plastic film;

wherein the thickness of said outer layer is less than the thickness of said inner layer, wherein the thickness of said inner layer is less than the thickness of said middle layer;

wherein said tubular member has a diameter, said diameter being less than about ¾ inch;

wherein said tubular member has a length defined between said ends of said tubular member, wherein said length is less than about 2 inches;

an elongate casing member having a generally C-shaped cross section and being detachably attachable to said outer surface of said tubular member, said casing member having a plurality of ribs and a plurality of elongate strips, wherein said casing member is transparent and comprises a resiliently deflectable material;

each of said ribs being generally C-shaped and having a pair of terminal ends and an arcuate portion, said arcuate portion of said rib having a mid-point substantially equidistant between said terminal ends of said rib;

each of said elongate strips having a pair of opposite ends, each of said elongate strips being coupled to each of said ribs;

said ribs being spaced apart from one another and generally parallel with one another, wherein said ribs are spaced apart substantially equidistant to one another;

wherein said plurality of ribs comprises five ribs;

a first of said ribs being positioned adjacent one of said ends of each of said elongate strips, a second of said ribs being positioned adjacent another of said ends of each of said elongate strips;

the rest of said plurality of ribs being interposed between said first and second of said ribs;

said elongate strips being spaced apart from one another and being extended generally parallel to one another;

wherein said plurality of elongate strips comprises three elongate strips;

a first of said elongate strips being positioned adjacent one of said terminal ends of each of said ribs, a second of said elongate strips being positioned adjacent another of said terminal ends of each of said ribs, a third of said elongate strips being positioned adjacent said midpoint of said arcuate portion of each of said ribs;

wherein said ribs are extendable around a portion of said outer surface of said tubular member such that said tubular member is held to said casing member to detachably attach said casing member to said tubular member; and a plurality of elongate flexible strands being adapted to resemble human hair, each of said flexible strands having a pair of opposite ends and a midpoint between said ends of said flexible strand, the midpoints of each of said flexible strands being coupled to said third of said elongate strips of said casing member such that said ends of said flexible strand extend outwardly from said third of said elongate strips.

* * * * *